US009816780B1

(12) United States Patent
Stefanick et al.

(10) Patent No.: US 9,816,780 B1
(45) Date of Patent: Nov. 14, 2017

(54) MULTI-FUNCTION LENS COVER

(71) Applicants: Matthew Thomas Stefanick, Franklin, TN (US); Freddie Santiago, Alexandria, VA (US)

(72) Inventors: Matthew Thomas Stefanick, Franklin, TN (US); Freddie Santiago, Alexandria, VA (US)

( * ) Notice: Subject to any disclaimer, the term of this patent is extended or adjusted under 35 U.S.C. 154(b) by 18 days.

(21) Appl. No.: 14/788,369

(22) Filed: Jun. 30, 2015

Related U.S. Application Data

(60) Provisional application No. 62/018,667, filed on Jun. 30, 2014.

(51) Int. Cl.
*F41G 1/38* (2006.01)

(52) U.S. Cl.
CPC ..... *F41G 1/383* (2013.01)

(58) Field of Classification Search
CPC ..... F41G 1/04; F41G 1/08; F41G 1/12; F41G 1/28; F41G 1/30; F41G 1/38; F41G 1/345; F41G 1/383; F41G 1/42; F41G 1/473; F41G 1/54; F41G 3/02; F41G 3/06; F41G 3/065; F41G 3/16; F41G 11/001; G02B 5/003; G02B 5/005; G02B 5/205; G02B 7/023; G02B 7/04; G02B 7/10; G02B 7/16; G02B 21/02; G02B 21/084; G02B 23/00; G02B 23/10; G02B 23/105; G02B 23/12; G02B 23/14; G02B 23/145; G02B 23/16; G02B 23/2423; G02B 23/2446; G02B 23/2461; G02B 23/2476; G02B 25/001; G02B 27/0018; G02B 27/0075; G02B 27/0189; G02B 27/646; G01S 7/4812; A61B 1/00183; A61B 1/0646; A61B 1/0669; G01C 3/04; G01C 3/08; G01C 3/32; B29B 2911/14326; B29B 2911/14333; B29B 2911/14453; B29C 2049/546; B29C 45/26; F21L 14/00; G03B 17/12; H04N 5/2254; H04N 5/2354
USPC ..... 359/196.1, 198.1, 210.1, 227, 234, 353, 359/381, 387, 399, 420–422, 425, 511, 359/695, 699, 700, 701, 739, 819, 822, 359/823, 825, 826; 42/111, 115, 119, 42/120, 124, 125, 129, 133; 89/37.1, 89/41.17; D16/134; 396/144, 505; 222/111; 348/E5.028
See application file for complete search history.

(56) References Cited

U.S. PATENT DOCUMENTS 5,020,892 A 6/1991 Glover et al.
5,589,906 A * 12/1996 Shimizu ..... G03B 9/06 396/505

(Continued)

*Primary Examiner* — Thomas K Pham
*Assistant Examiner* — Ibrahima Diedhiou
(74) *Attorney, Agent, or Firm* — Birdwell & Janke, LLP

(57) ABSTRACT

A lens cover for, and a method of reducing the signature of, an optical imaging system presented. A support structure is provided having a first ring-shaped end, a second ring-shaped end and a mounting portion for attaching one end of the support structure to a lens. A rotatable member is disposed at the second end of the support structure. A pliable membrane tube has a first end attached to the first ring-shaped end of the support structure and a second end attached to the second ring-shaped rotatable member so that the membrane tube forms an aperture. By rotating the rotatable member to twist the membrane tube the size of said aperture may be varied.

23 Claims, 16 Drawing Sheets

(56) References Cited

U.S. PATENT DOCUMENTS

| | | | | |
|---|---|---|---|---|
| 7,828,450 | B2 | 11/2010 | Riley | |
| 2009/0046365 | A1 * | 2/2009 | Moore | G02B 27/0006 359/511 |

* cited by examiner

MULTI-FUNCTION LENS COVER

REFERENCE TO RELATED APPLICATION

Applicants hereby claim the benefit of priority under 35 U.S.C. §120 to Stefanick et al. U.S. Provisional Patent Application No. 62/018,667, filed Jun. 30, 2015 and entitled MULTI-FUNCTION LENS COVER, the entire contents of which are hereby incorporated by reference in this disclosure.

FIELD

The present invention relates generally to accessories for optical imaging systems, particularly direct-view optical ("DVO") imaging systems, such as riflescopes, binoculars, and spotting scopes, and to camera-based optical ("CBO") imaging systems. More specifically, the present invention relates to a multi-function lens cover adapted to be fitted on the objective or ocular (eye-piece) lenses of a direct-view optical DVO system or a CBO system.

BACKGROUND

Stray light in an optical imaging system, be it a rifle scope, spotting scope, or CBO system, can be a result of internal reflections off surfaces within that imaging system from sources outside of the designed-for-field-of-view. This is illustrated by the light ray-trace diagram for a typical riflescope shown in FIG. 1. In that diagram, the rifle scope optics 10 comprise an objective lens system 12, a relay lens system 14, and an ocular lens system 16, which present the transformed incoming bundle of rays 18 from a distant object along the optical axis 20 of the imaging system to the user's eye 22. (The term "lens" is used herein to refer to one or a combination of two or more lens elements, while the term "lens system" is used only to refer to a combination of two or more lens elements.) However, off-axis stray light rays 24 that enter the system 10 through the objective lens system 12 can cause spurious reflections within the imaging system that also reach the user's eye through the ocular lens system 16. When such off-axis sources are particularly bright, the glare produced can compete with the light of the on-axis image, resulting in degradation of, or an inability to see, images of objects of interest presented to the eye. It would be desirable to be able to block this off-axis light and thereby preclude it from reaching the eye or, in the case of a CBO imaging system, the camera detector.

Many DVO and CBO systems are typically used outdoors. In such use it is particularly desirable to protect the exposed objective and ocular lenses from environmental degradation. This is because the objective lens is typically the largest, most expensive and, usually, most vulnerable lens in an imaging system. But, in addition, localized imperfections in the ocular lens system, e.g., chips in a lens, mud on a lens surface, and other physical variations from the imaging system design can dramatically impact the ability of DVO system to image the field angle to which the imperfection corresponds. Consequently, it is desirable to be able to protect entirely these optical surfaces from hazards in the environment.

When an imaging system is used in a military environment, a law enforcement environment or the like, the optical "signature" that such a system presents to persons other than the user, that is, light reflected from the system, is especially important. Reflections, e.g., sun "glint," from the objective lens or interior surfaces of the imaging system, represent a signature that can be seen or detected by an adversary. The magnitude of the optical return signature is proportional to the cross sectional area of the optical component. This means, for example, that by reducing the optical clear aperture diameter of the imaging system by a factor of 1/X, the optical signature power is reduced by a factor of $1/X^2$ (where X>1). Because of this characteristic, it would be desirable to have a variable diameter aperture disposed in front of the objective lens that enables an operator to minimize this optical signature power, while simultaneously balancing that desire against the quality of the image and exit pupil diameter produced to the user.

At night, military and law enforcement situations often require the use of an "in-line" night vision device with an optical imaging system adapted to image relatively long wavelength light that is not significantly visible to the human eye. For example, as shown in FIG. 2, a night vision device 26 may be disposed in front of the objective lens 28 of a DVO system, specifically a rifle scope 30, to present to the DVO a visible-light representation of an infra-red image. Such devices typically are afocal, meaning they optimally present an image of nominally collimated light to a wavelength-shifting display and optical amplifier 32 to produce a visible collimated light to the rifle scope 30. A hazard of using such an imaging system, is that the relatively bright display represents a source of visible light 34 which can be reflected off of the convex objective lens 28 of the rifle scope 30, or exterior components of the system, and re-directed toward an adversary as shown by ray 36.

Further, it is not uncommon to use thermal in-line night vision devices with telescopic optical imaging devices during the day for target detection. Such devices image mid-to-long wave infrared radiation that is a function of temperature only, not ambient visible illumination. But the magnifying lenses that collimate the visible display, for presentation to the DVO, are typically smaller and have a narrower field angle than the DVO to which they are coupled. This presents a problem, because the DVO objective lens can collect visible light within its wider field of view, in addition to the magnified display designed to be seen, as illustrated by light ray 38 in FIG. 2. This competing information, that is, thermal light converted to visible light and direct visible light from around the edges of the thermal imaging system, represents a degradation in imaging performance.

For such night and day applications of an in-line night-vision device, in conjunction with a DVO system, it would be desirable to have a means of preventing visible light from exiting (night) and entering (day) the optical train of the entire imaging system.

SUMMARY

A lens cover for, and a method of reducing the signature of, an optical imaging system presented.

Generally, but without limitation, the lens cover comprises a support structure having a first ring-shaped end, a second ring-shaped end and a mounting portion for attaching one end of the support structure to a lens; a ring-shaped rotatable member disposed at the second end of said support structure; and a pliable membrane tube having a first end attached at its periphery to the first ring-shaped end of the support structure and having a second end attached at its periphery to the ring-shaped rotatable member so that the membrane tube forms an aperture through the support structure and by rotating the rotatable member to twist the membrane tube the size of said aperture may be varied.

More specifically, in such a lens cover the support structure may comprise an enclosure tube, the first ring-shaped end of the support structure comprising a first end of the enclosure tube and the second end of said support structure comprising a second end of the enclosure tube, the membrane tube being disposed within the enclosure tube. Preferably, the enclosure tube comprises at least one substantially light-impenetrable wall. Also preferably, the enclosure tube comprises a first substantially-rigid tube member and a second substantially-rigid tube member having a common longitudinal axis, the first tube member having an outside diameter less than the inside diameter of the second tube member and being disposed within the second tube member so that the first tube member can rotate inside the second tube member about the common longitudinal axis and thereby twist the membrane tube.

Generally, but without limitation, the method comprises providing a pliable membrane tube having a front end, a back end and a central longitudinal axis, the back end being adapted to be attached to the front of the lens; supporting said pliable membrane tube in front of the lens so as to create an aperture for light propagating between the front end of the membrane tube and the front of the lens; and rotating one end of the membrane tube with respect to the other end of the membrane tube so as to twist the membrane tube and thereby vary the size of the aperture for light propagating between the front end of the membrane tube and the front of the lens.

It is to be understood that this summary is provided as a means of generally determining what follows in the drawings and detailed description, and is not intended to limit the scope of the invention. Objects, features and advantages of the invention will be readily understood upon consideration of the following detailed description taken in conjunction with the accompanying drawings.

DETAILED DESCRIPTION OF EMBODIMENTS

Figure 5:
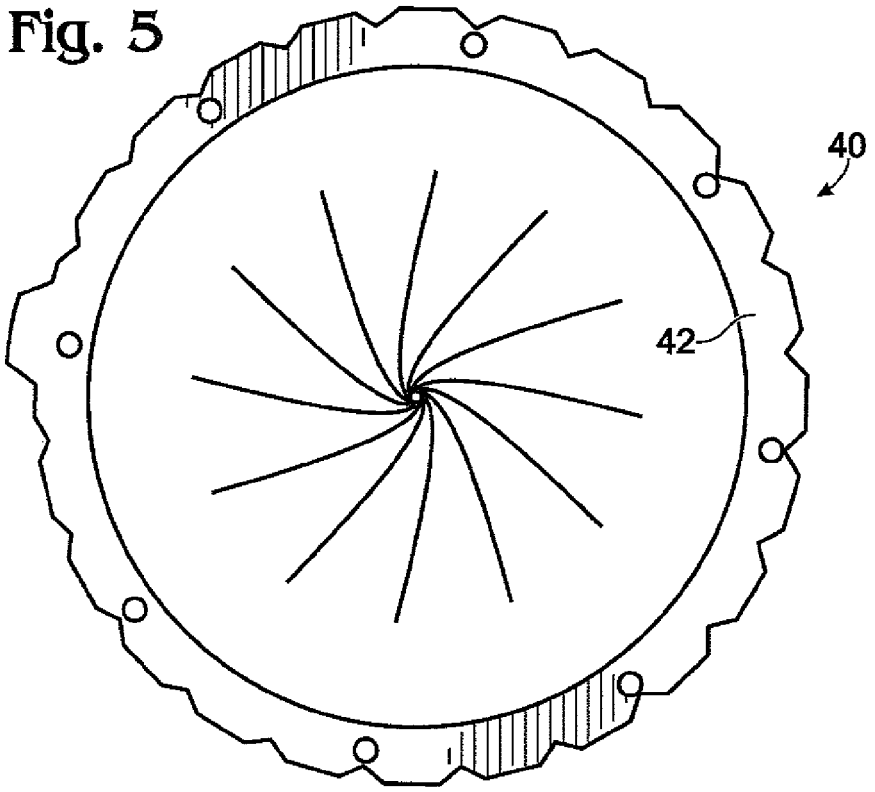
FIG. 5 is a front view of the embodiment of FIG. 3 in a closed state.
Figure 6:
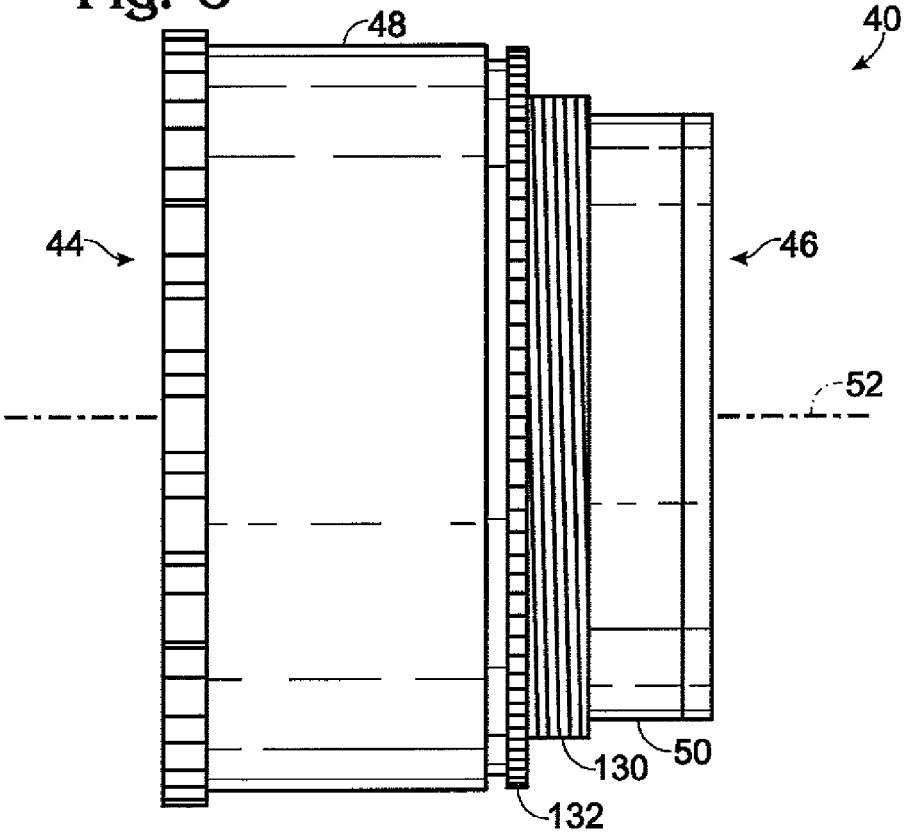
FIG. 6 is a side view of the embodiment of FIG. 3.
Figure 7:
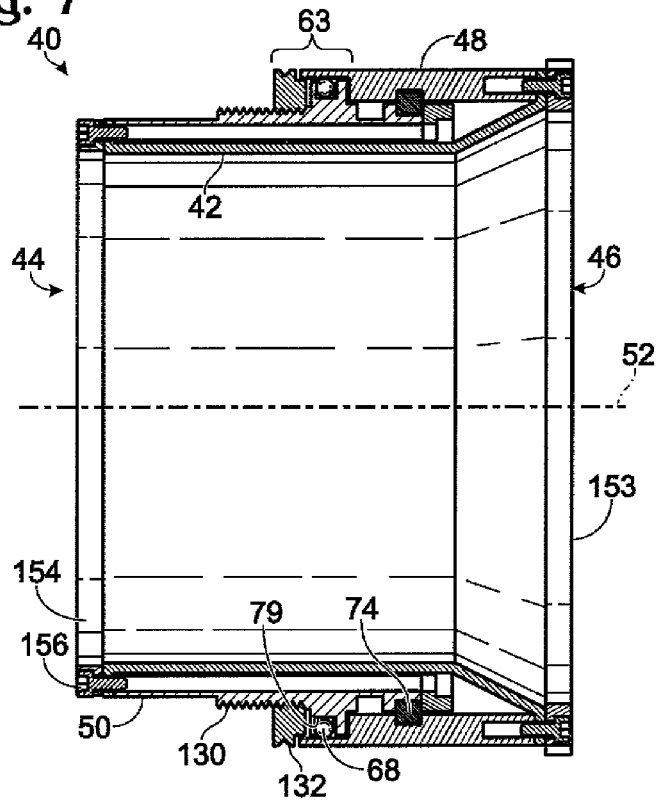
FIG. 7 is a cross section of the embodiment of FIG. 3.
Figure 8:
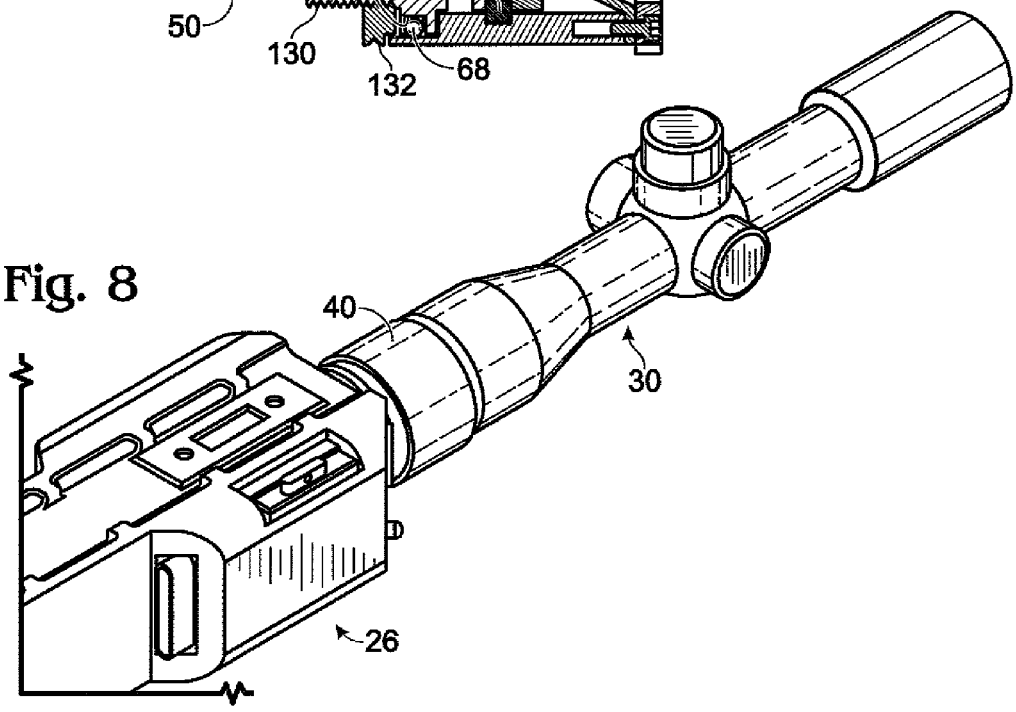
FIG. 8 is a perspective of the lens cover embodiment of FIG. 3 mounted on a rifle scope.

Referring to FIGS. 3-7 a preferred embodiment of a multi-purpose lens cover 40 comprises a pliable tube membrane 42 having front and back ends 44 and 46, respectively. The tube membrane 42 is circumferentially attached to the rims of two respective outer and inner rigid tube members 48 and 50 that are aligned symmetrically and can be rotated about the optical axis 52 of the device. The pliable tube membrane 42 is disposed inside of the rigid tube members 48 and 50 such that, when the outer tube member 48 is rotated relative to the inner tube member 50, the membrane 42 twists and closes up symmetrically about the optical axis 52. FIG. 7 shows a cross section of the lens cover 40 in a fully open state. FIG. 8 shows the lens cover 40 attached to rifle scope 30 and night vision device 26

Figure 3:
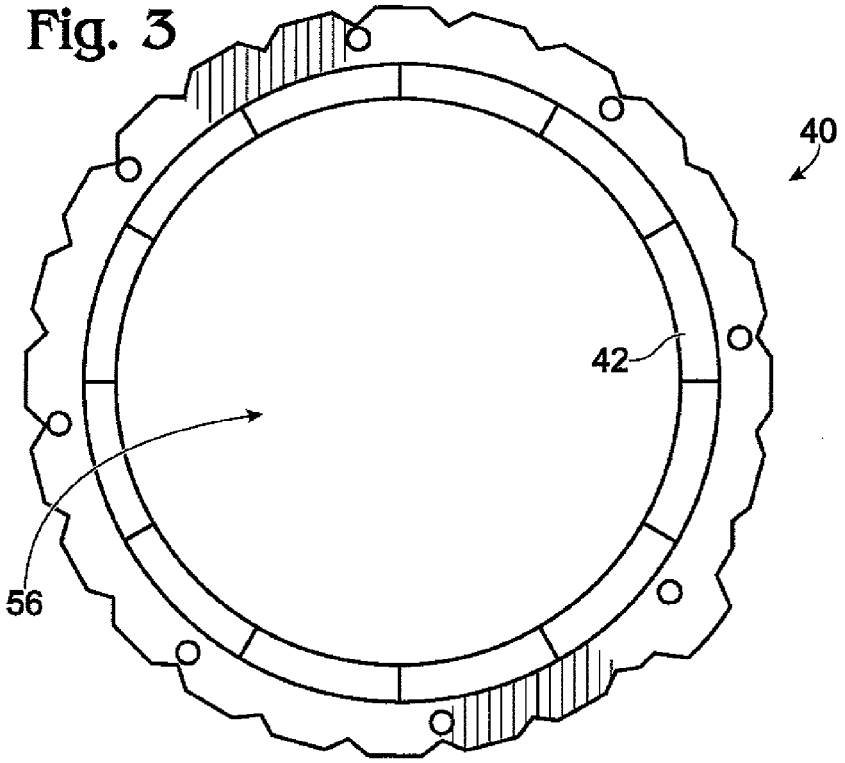
FIG. 3 is a front view of a preferred embodiment of a multi-purpose lens cover in an open state.
Figure 4:
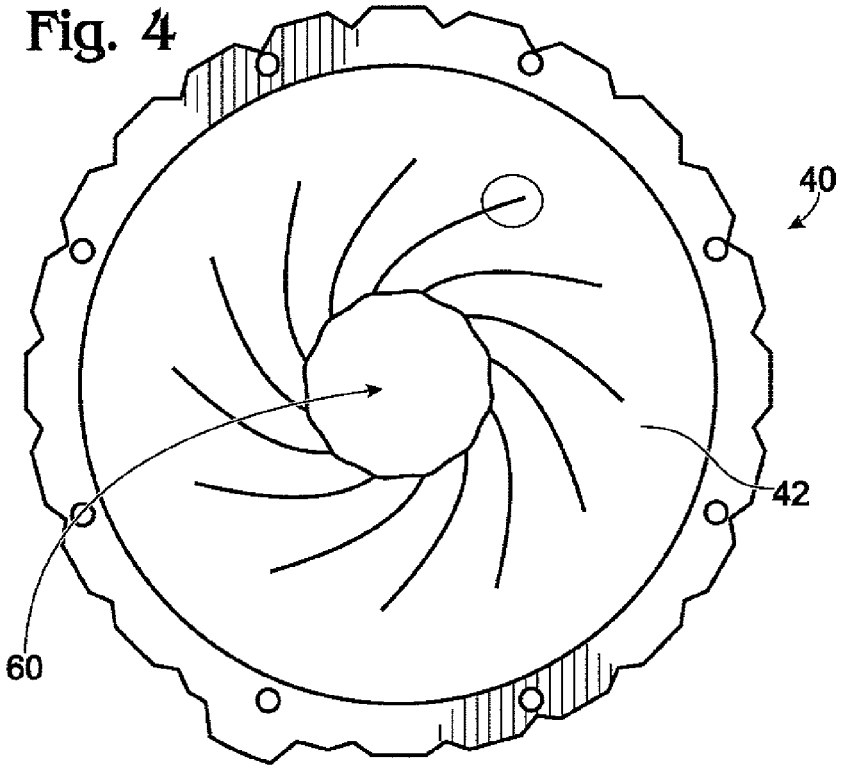
FIG. 4 is a front view of the embodiment of FIG. 3 in a partially open state.
Figure 9:
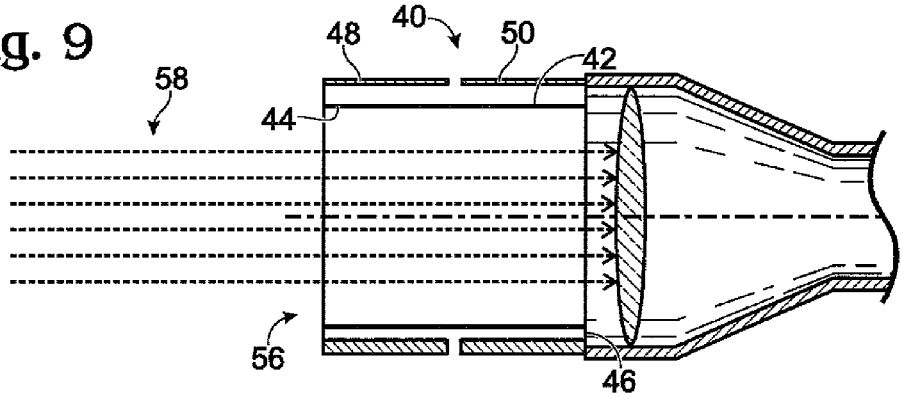
FIG. 9 is a simplified cross sectional diagram of the embodiment of FIG. 3 showing the lens cover in an open state.
Figure 10:
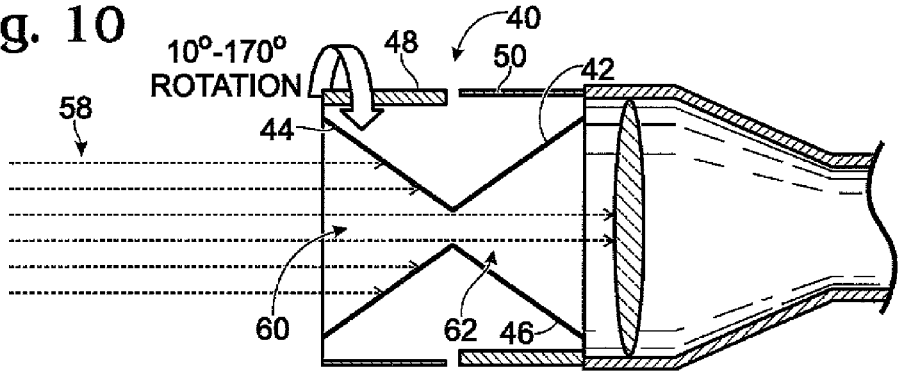
FIG. 10 is a simplified cross sectional diagram of the embodiment of FIG. 3 showing the lens cover in a partially open state.
Figure 11:
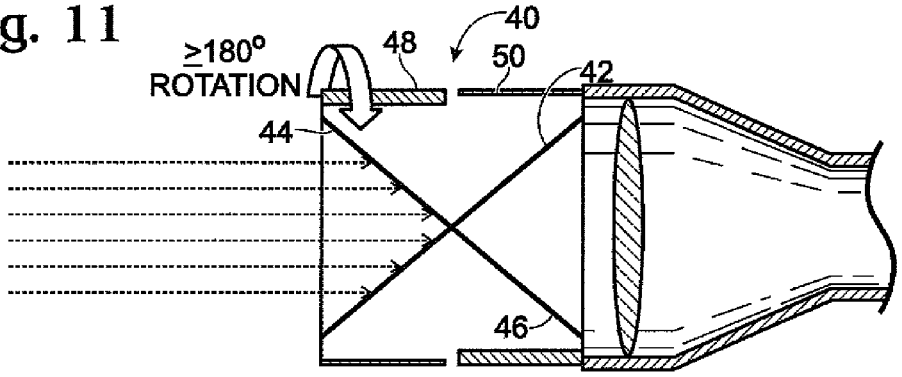
FIG. 11 is a simplified cross sectional diagram of the embodiment of FIG. 3 showing the lens cover in a closed state.

FIGS. 9, 10 and 11, which are idealized schematic cross-section diagrams that illustrate the operation of the lens cover 40, correspond to FIGS. 3, 4 and 5, respectively.

FIGS. 3 and 9 illustrate an open state of the lens cap in which the tube membrane 42 is essentially untwisted, thereby presenting a large aperture 56 that allows all of the light rays 58 to pass through the lens cover 40. FIGS. 4 and 10 illustrate a partially open state, in which the tube membrane 42 is partially twisted, thereby presenting a smaller aperture 60 that allows only a portion 62 of the light rays 58 entering the lens cover 40 to pass there through. FIGS. 5 and 10 illustrate a closed state, in which the tube membrane 42 is fully twisted, thereby presenting an essentially closed aperture whereby none of the light rays 58 passes through the lens cover. FIGS. 9-11 also illustrate the effective action of closing the membrane 42 by rotating the rigid members outer rigid tube 48 with respect to the inner rigid tube 50.

Referring specifically to FIG. 7, the rigid tubes 48 and 50 are rotationally guided by a coupling 63 such that they reliably rotate about the longitudinal, or optical, axis 52. For simplicity, a preferred mechanism for providing rotational guidance employs an O ring 68 disposed in a groove 79 integral to the inner tube 50, and a bushing 74, which rotationally connect the inner tube 50 with the outer tube 48.

Figure 12:
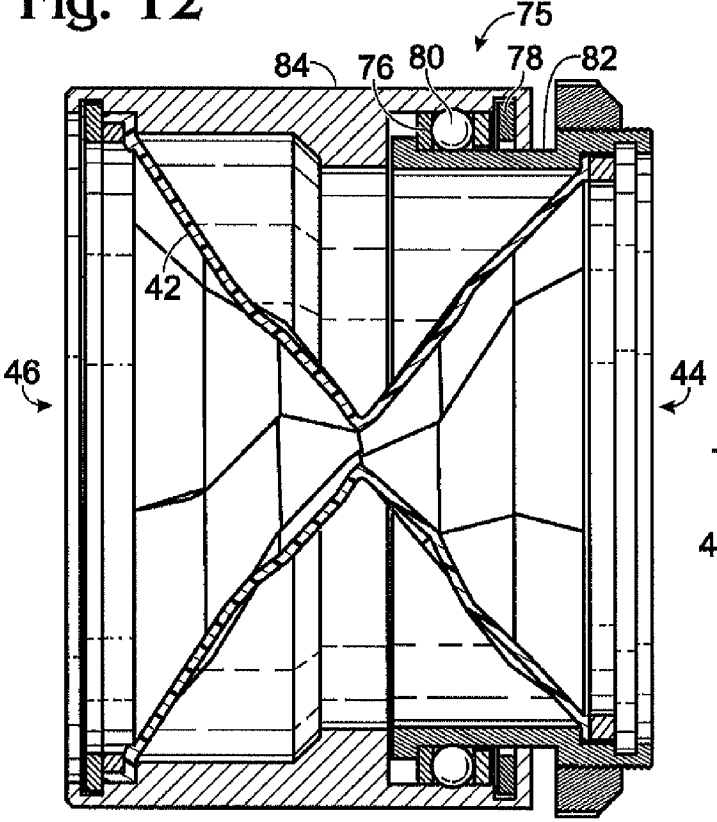
FIG. 12 is a cross section of a first alternative embodiment of the lens cover in a partially open state.

Alternatively, as shown FIG. 12, in another embodiment 75 of the lens cover two bushings 76 and 78, disposed respectively on opposite sides of a sealing O ring 80 serve to provide rotation between an inner tube 82 and an outer tube 84. Alternatively, a thin section ball bearing, a solid bushing or an O ring by itself (having a square, round or other shape) can serve as the rotational guidance if placed in the same location as the bushings in FIG. 12.

Figure 13:
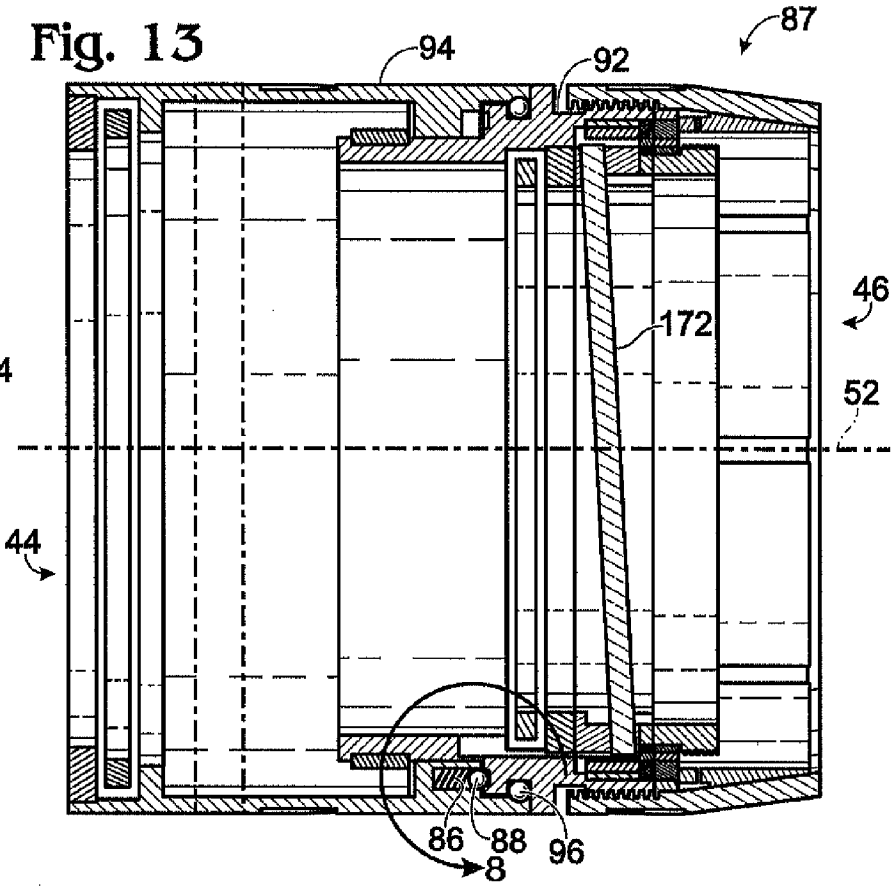
FIG. 13 is cross section of a second alternative embodiment of the lens cover including a female collet attachment and a ball detent feature.
Figure 14:
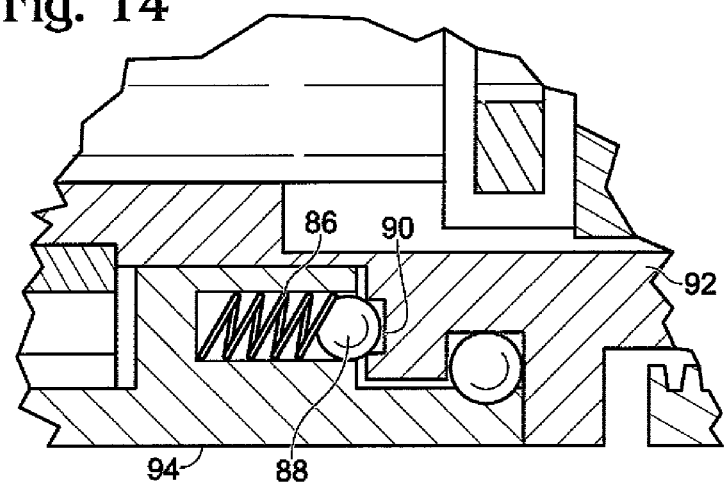
FIG. 14 is a detailed cutaway of FIG. 13 focusing on the ball detent feature.

At the cost of more complexity in yet another embodiment 87 of the lens cover, shown in FIGS. 13 and 14, the coupling mechanism for providing rotation guidance may also comprise a spring 86 and ball 88 detent system that enables the tube membrane (not shown) to be held in a partially closed state. In this embodiment a plurality of distinct detents 90 in the inner tube 92 are distributed around the periphery of the inner tube so as to allow the ball 88 to be forced therein by the spring 86, thereby lightly locking the outer tube 94 in a radial position with respect to the inner tube 92 until increased rotational torque is applied. Concomitantly, the tube membrane is locked at a corresponding amount of twist until more torque is applied to change the amount of rotation of the outer ring and corresponding membrane twist.

Figure 36:
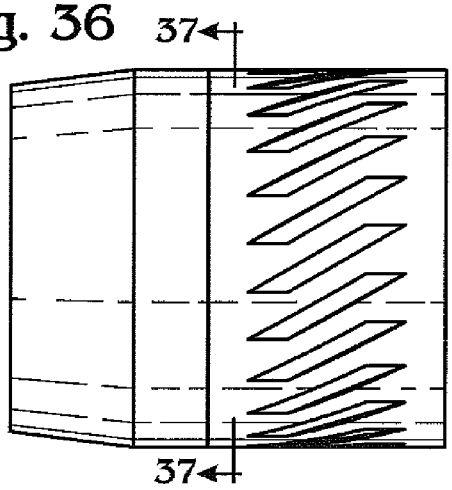
FIG. 36 is a side view of a twelfth embodiment of the lens cover including press fit mounting mechanism.
Figure 37:
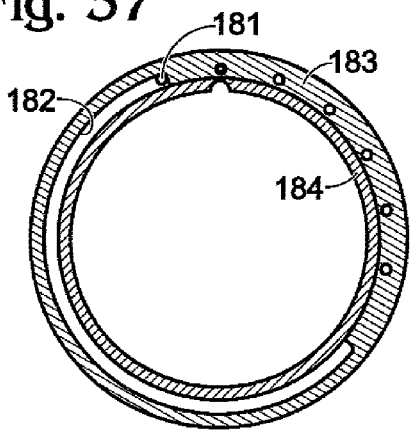
FIG. 37 is and end section of the lens cover of FIG. 36, showing an outer rigid tube rotation stop.

Preferably, as shown in the embodiment of FIG. 36 and section view FIG. 37 the rotation of the outer rigid tube 183 relative to the inner rigid tube 184 is limited at the fully open and fully closed positions by hard stop 181 and 182 integrated into the rigid outer and inner tubes 183 and 184, respectively, as shown in FIG. 37.

Membrane Structure

Preferably the tube membrane 42 in each of the embodiments described above and most embodiments described hereafter is sufficiently durable to prevent abrasion and puncture by sharp objects ordinarily. Also preferably, except as specifically described hereafter, the structure of the lens cover is adapted to keep the membrane under tension so as to ensure that there is no slack and there are no wrinkles in the membrane, particularly in the most open position, that would otherwise block the field of view of an optical imaging system to which the lens cover is attached, or at least not in an asymmetrical way. To that end, the tube membrane preferably comprises one of the following five different membrane embodiments.

Figure 15:
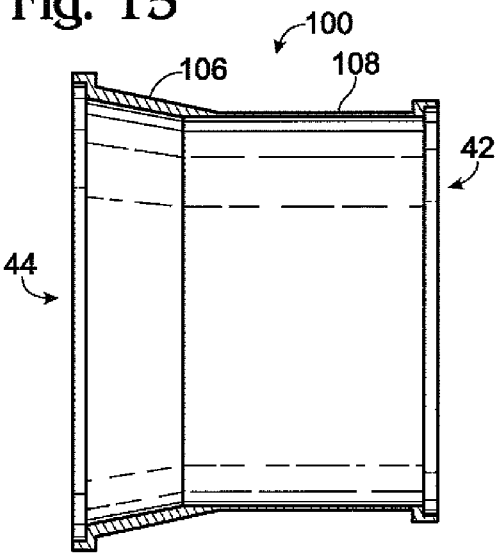
FIG. 15 is a cross section of a lens cover membrane having an axially changing thickness profile.
Figure 16:
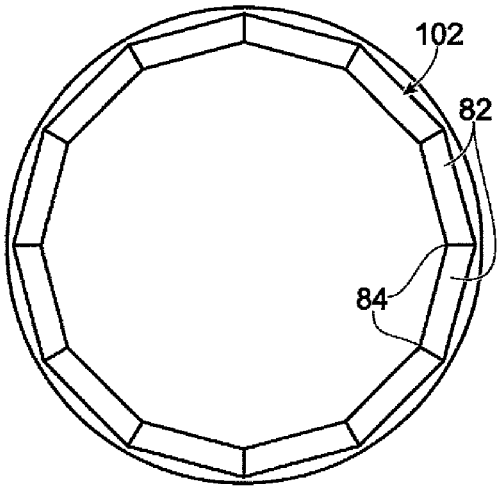
FIG. 16 is a front view of a lens cover membrane having a radially changing thickness profile.
Figure 17:
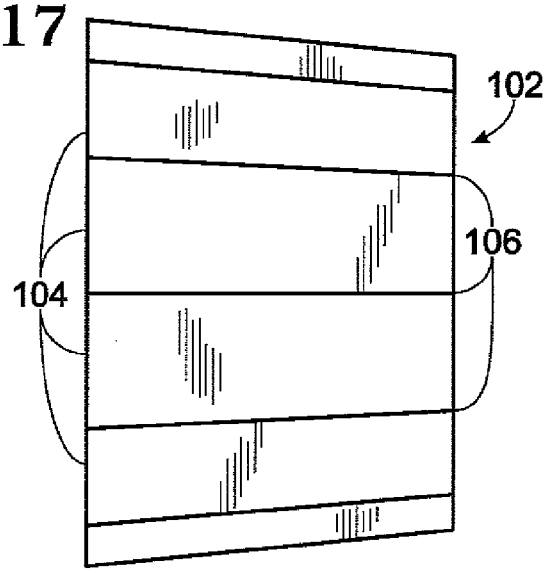
FIG. 17 is a side view of the membrane shown in FIG. 16.
Figure 18:
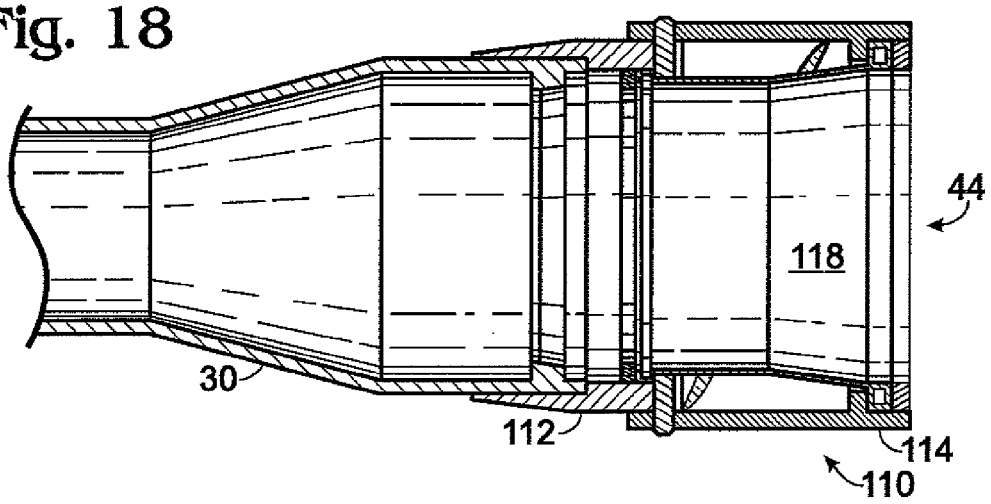
FIG. 18 is a cross section of third alternative embodiment of the lens cover having a non-elastic membrane shown in an open state.

1. All elastic (stretchy/elastic) membrane: The tube membrane 42 may comprise an elastic material such as rubber or polymer (including but not limited to any of butyl, latex, neoprene, silicone, nitrile, polyurethane), as shown, for example, in FIG. 7. Preferably, the membrane is installed in a pre-stretched state so there is tension on the membrane holding it tight in the open position. As the outer tube 48 is rotated to open or close the aperture of the lens cover 40, the elasticity of the membrane alone keeps tension on the membrane. The thickness of the membrane should be chosen to be thick enough for the desired strength to achieve acceptable durability.
2. All elastic (stretchy/elastic) membrane with varying thickness profile in the axial direction: Using the same types of materials as in embodiment (1) above, the membrane 42 can be provided with a thickness profile along the direction of the optical axis 52 to give the membrane better performance. For example, in areas where there is more stress on the membrane it can be made relatively thick, or to improve its closing performance it can be made relatively thin in the midsection and relatively thick toward the front and back portions. FIG. 15 shows an axially profiled membrane 100 having a front portion 106 that is relatively thick and a back portion 108 that is relatively thin.
3. All elastic (stretchy/elastic) membrane with varying thickness profile in the radial direction (ribs): The membrane may also, or in the alternative, have a thickness profile in the radial direction. This allows for longitudinally oriented features or ribbing. This type of feature can help add reinforcement to the membrane and to permit higher tension to be applied. Radial thickness profiling can also give the membrane a preferential folding shape which can increase its closing performance. FIGS. 16 and 17 show a membrane 102 using the radial thickness profiling so as to provide thick sections 104 and thin sections 106 that run longitudinally along the membrane.
4. Partially elastic membrane: For many, if not most, most elastic materials a thicker-than-optimal material is needed to achieve optimal abrasion and puncture resistance. Consequently, a preferred membrane material is a comolded or bonded puncture resistant fabric or film on the front facing portion of an elastic membrane. Such fabric or film may be made from a strong and flexible material such as nylon, polyester, aramid, polyamide, PEEK, cotton, carbon fiber, ultra-high-molecular-weight polyethylene fiber, or similar material. This reinforcement reduces or eliminates the elasticity of the tube membrane in the portion of the tube membrane where it would ordinarily be used to add durability to the front portion which is particularly prone to abrasion and puncture. However, even when the fabric or film is used in the front portion of the tubular membrane, the rear facing portion is still fully elastic and can ordinarily provide sufficient tension on the membrane. The co-molding or bonding also seals the fabric so the cover maintains its ability to seal out debris and liquids.

5. All non-elastic membrane: This membrane embodiment is similar to the previous embodiment 4 except the reinforcement is included throughout the entire length. This means that the membrane, while flexible, has minimal elasticity (stretch).

Figure 19:
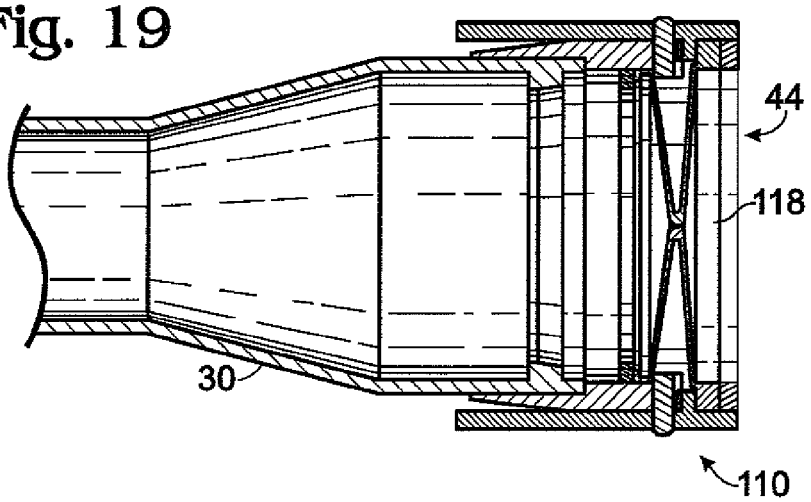
FIG. 19 is a cross section of the lens cover embodiment of FIG. 18 with the membrane shown in a closed state
Figure 20:
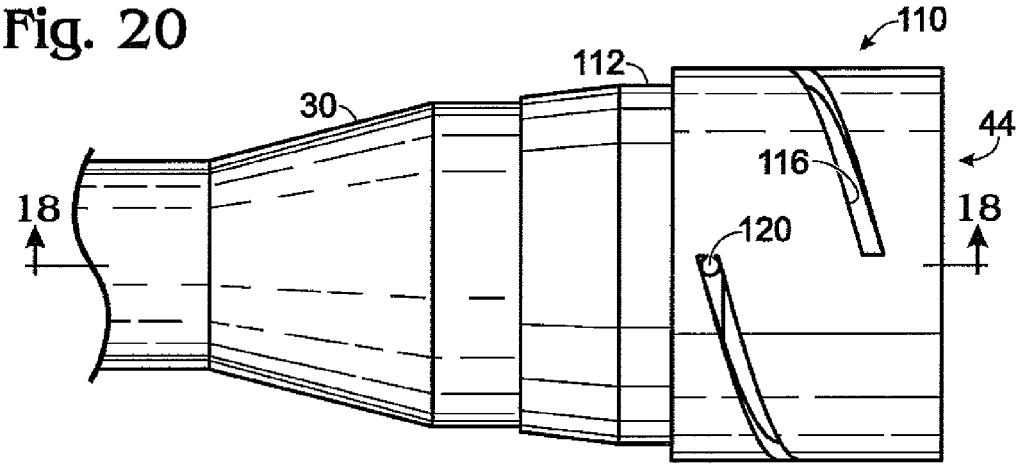
FIG. 20 is a side view of the embodiment of FIG. 18 with the membrane in and open state.
Figure 21:
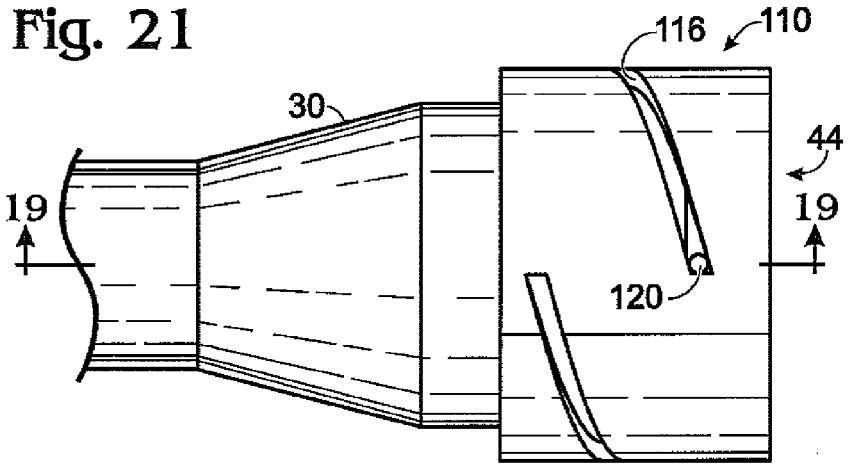
FIG. 21 is a side view of the embodiment of FIG. 18 with the membrane in a closed state.

FIGS. 18-21 show an embodiment 110 of a lens cap that incorporates this feature. The lens cap 110 in these figures has an inner rigid tube 112 and a rotating rigid outer tube 114 having a helical slot 116. A non-elastic membrane 118 folds like an accordion when the outer ring is rotated, so as to close the aperture there through, as shown in FIGS. 19 and 21. When the membrane is expanded, as in FIGS. 18 and 20, the aperture opens up to a maximum and the membrane 118 length is at maximum. As the lens cover is rotated towards a closed position, thus reducing the aperture, the rigid outer tube 114 translates axially with the rotating motion due to a pin or cam 120 which fits within the helical cam slot 116 thereby keeping tension on the membrane. This axial motion of the outer tube member allows the membrane to twist closed without requiring the membrane to stretch to accommodate this motion. This motion could alternatively be guided by threads between the rigid tube members. This embodiment is, mechanically, more complicated but offers a particularly robust membrane design.

A cover lens in accordance with this disclosure may use a combination of any of these membrane embodiments, to varying degrees, to achieve maximum performance.

Mounting the Lens Cover on an Optic

Figure 22:
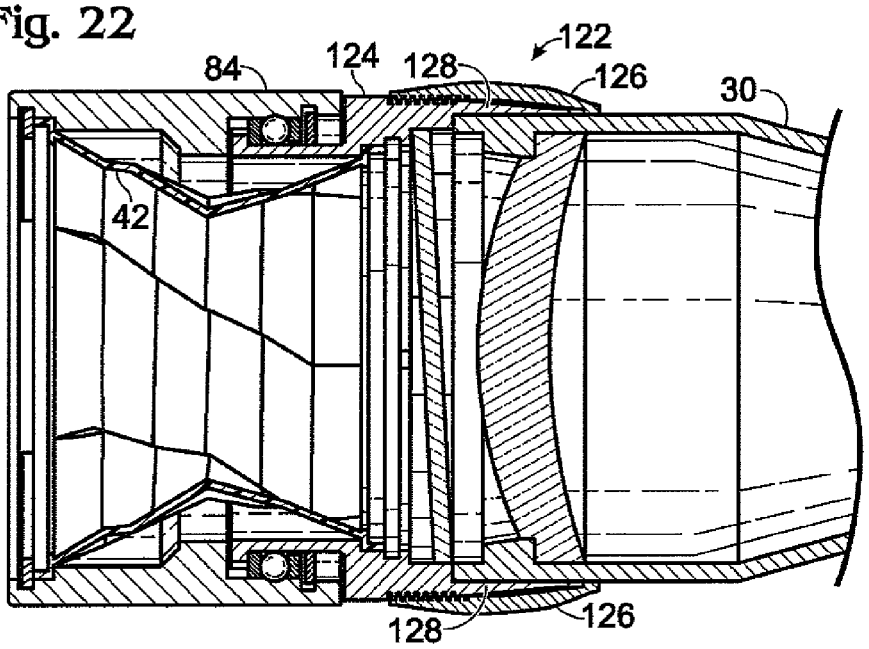
FIG. 22 is a section of a fourth embodiment of the lens cover that includes an optical filter mounted inside the lens cover.
Figure 23:
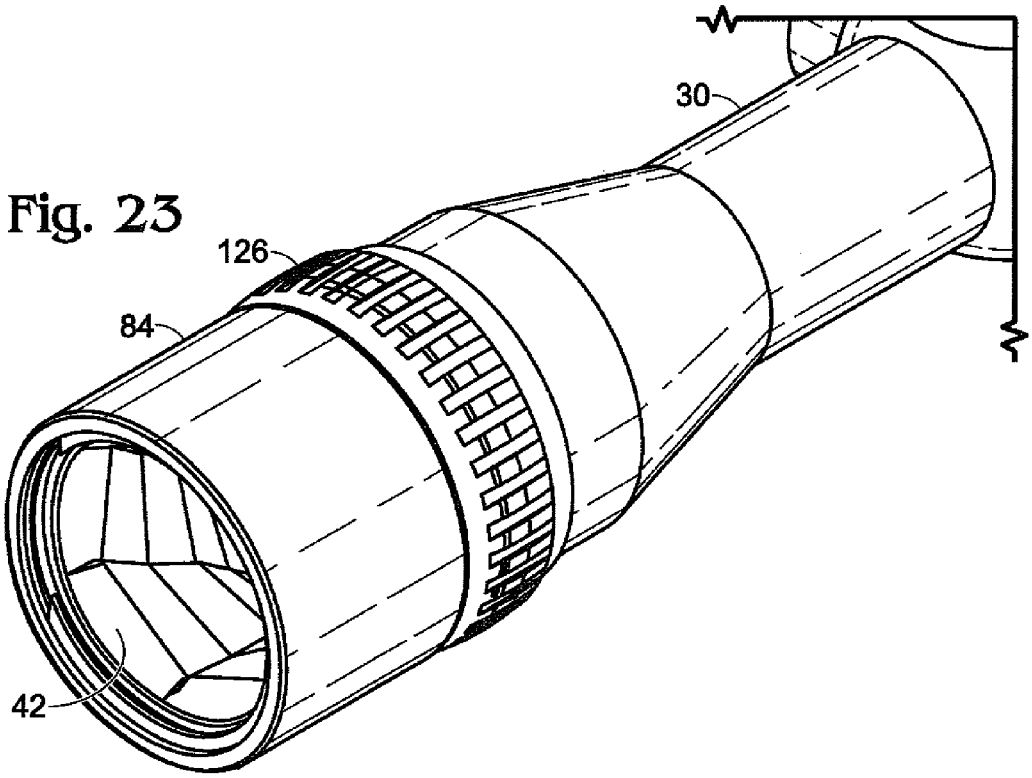
FIG. 23 is a perspective view showing a fifth embodiment of the lens cover including a female collet attachment mounted on a typical rifle scope.
Figure 24:
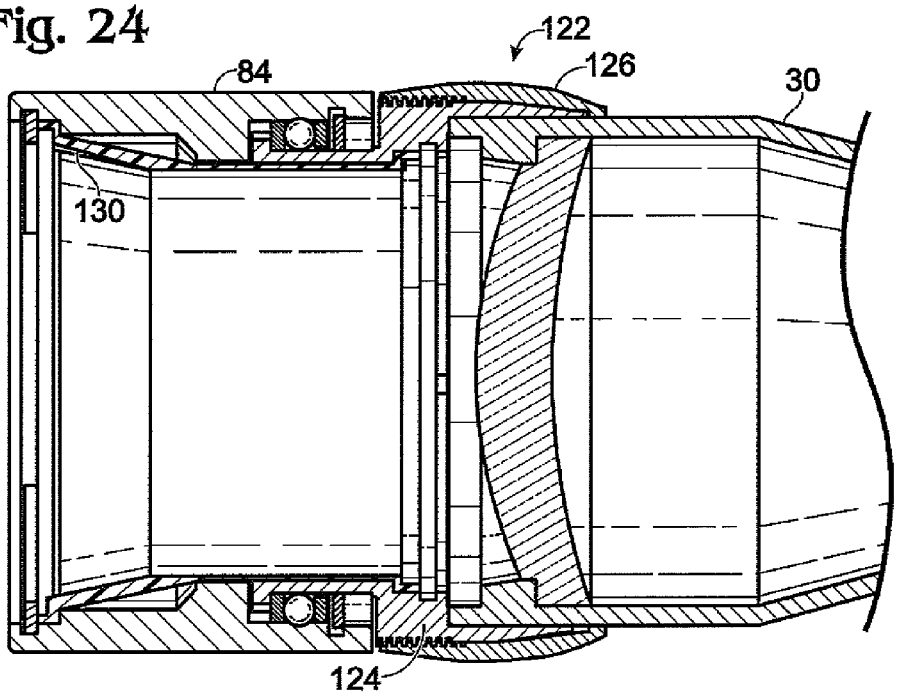
FIG. 24 is a partial section of FIG. 23.

The lens cover may be mounted to the optic by an external collet 122 of a lens cover otherwise similar to the lens cover of FIG. 12, as shown in FIGS. 22, 23 and 24. This utilizes a female collet system built into to the inner rigid tube 124 that slips over the outside of the objective lens housing of a DVO, which, for example may be a rifle scope 30. A tapered threaded collar (collet locking ring) 126 tightens against the finger 128 of the collet to grip the outside of the housing of the DVO. This has the advantage of preventing the lens cover from coming loose as a result of repeated rotational action to open and close the cover. This is the preferred mounting mechanism for the lens cover according to this disclosure. FIG. 24 shows a similar lens cover, but for its use of membrane 130, like that shown in FIG. 15, where it is thicker in the front than in the back.

Alternatively, a lens cover according to this disclosure may be mounted to the DVO using several other methods. As shown in FIGS. 6 and 7, male threads 130 may be provided on the rigid inner tube 50 to mate with a desired optic having matching female threads. Preferably, a lock ring 132 is also provided. The lock ring is adapted to thread onto the male threads 130 of the lens cover before the cover is mounted on the optic. After the lens cover is screwed into the female threads of the optic, the lock ring can be screwed against the optic housing to apply tension to the threads and thereby secure the lens cover on the optic.

Figure 25:
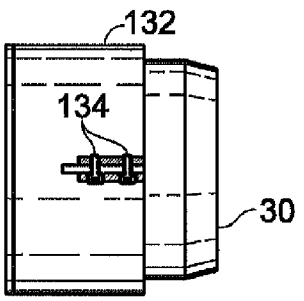
FIG. 25 is shows a generalized, sixth embodiment of the lens cover having a collar and pinch bolt mounting mechanism.
Figure 26:
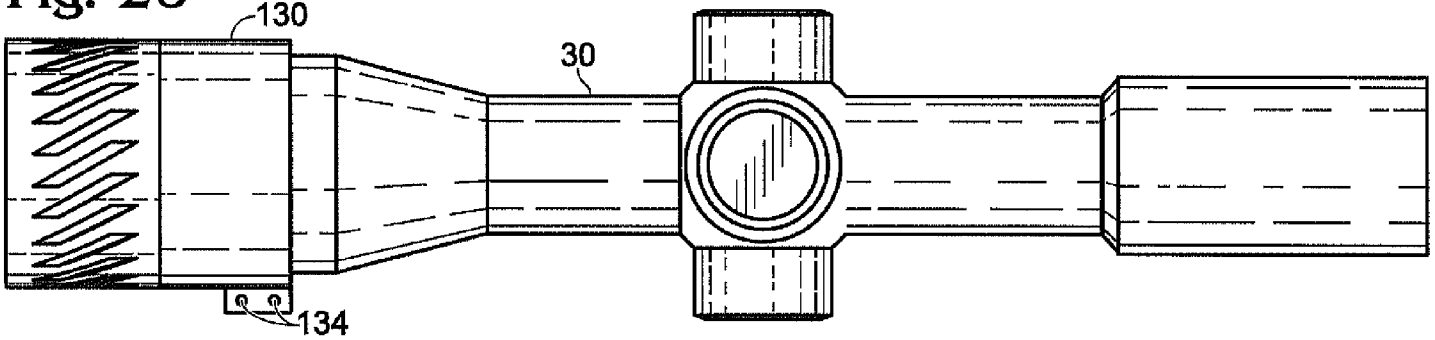
FIG. 26 is a side view of lens cover including the collar and pinch bolt mounting mechanism, mounted on a typical rifle scope.

Another device and method for mounting the lens cover comprises an external clamping ring built into the inner rigid tube 132 secured by one or more pinch bolts 134, as shown in FIGS. 25 and 26. This is similar to the female collet system except that instead of using the collet fingers to clamp onto the housing, the inner rigid tube is provided with one or more slots and associated bolts that, when tightened, bring the material on either end of the slot together thereby securely fastening the lens cover onto the DVO.

Figure 27:
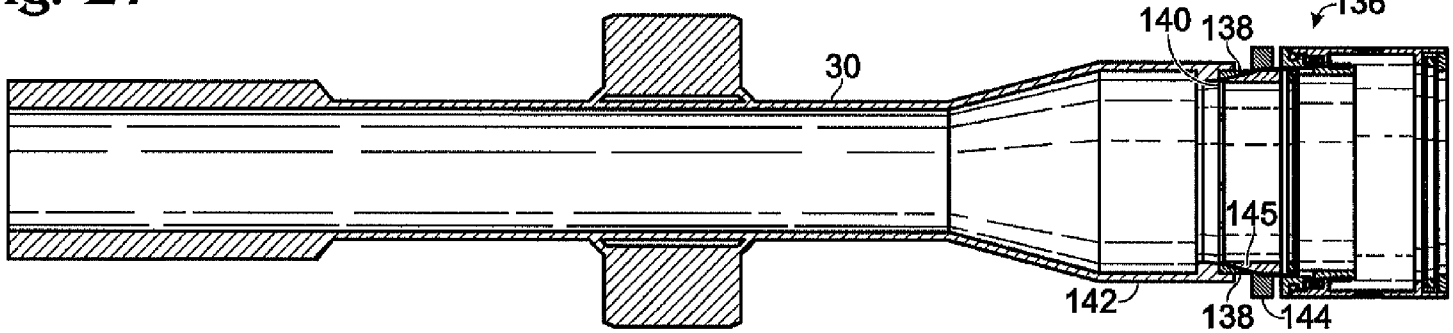
FIG. 27 is a section of a seventh embodiment of the lens cover including a male collet and mounted on a typical rifle scope.
Figure 28:
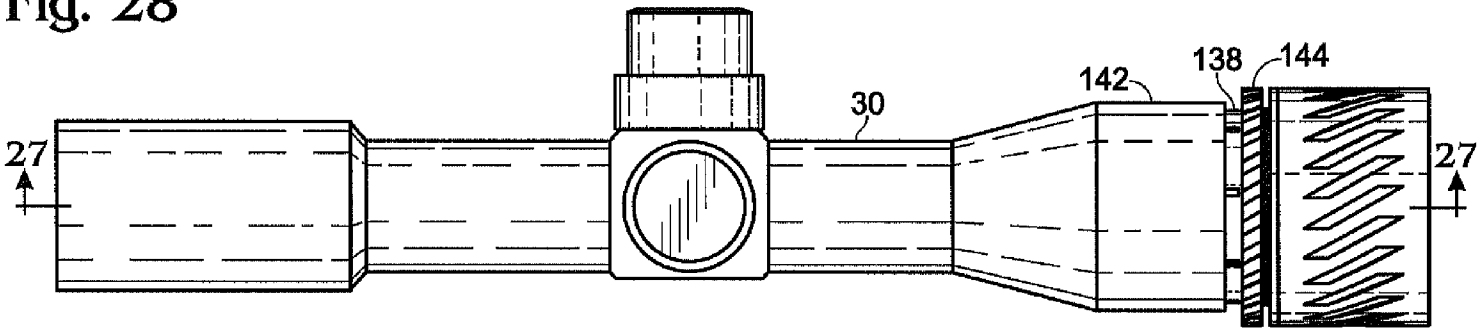
FIG. 28 is a side view of embodiment of FIG. 27 mounted on the rifle scope.
Figure 29:
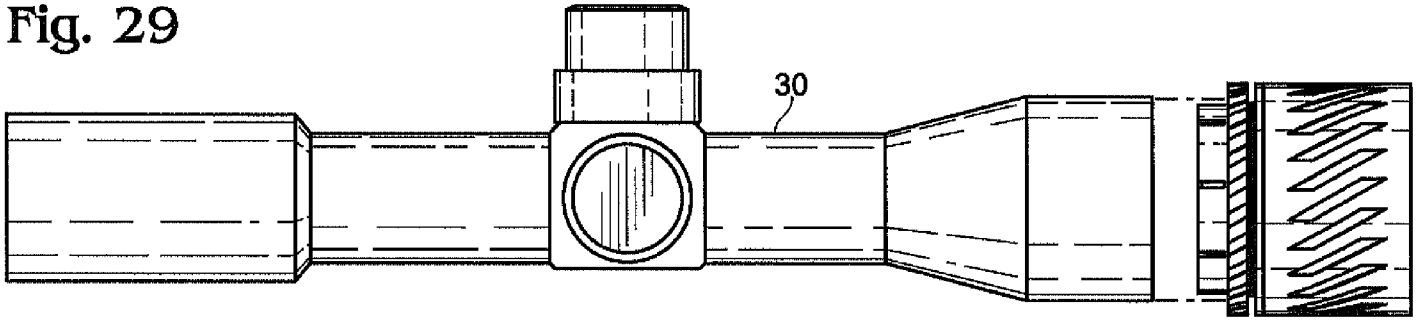
FIG. 29 is a side view of the lens cover embodiment of FIG. 27 shown outside the rifle scope.

An internal collet system 136, as shown in FIGS. 27 and 28, provides yet another device and method for mounting the lens cover to the DVO. This is similar to the external collet system, but the collet 136 is inverted such that fingers 138 of the collet push out and clamp against the inside 140 of the objective lens housing 142 in response to rotation of a collet ring 144 that, when rotated, force a wedge 145 under the fingers 138.

Figure 30:
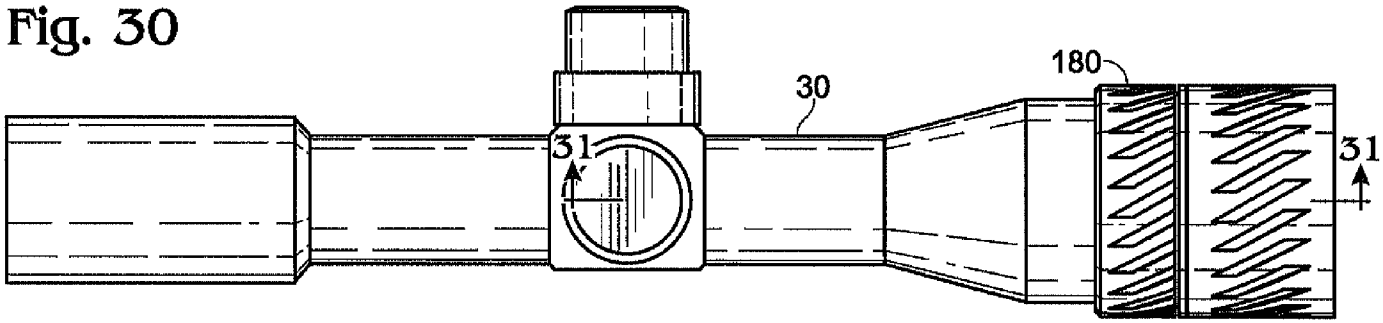
FIG. 30 side view of an eighth embodiment of the lens cover including a compression fitting mounting mechanism mounted to a typical rifle scope.
Figure 31:
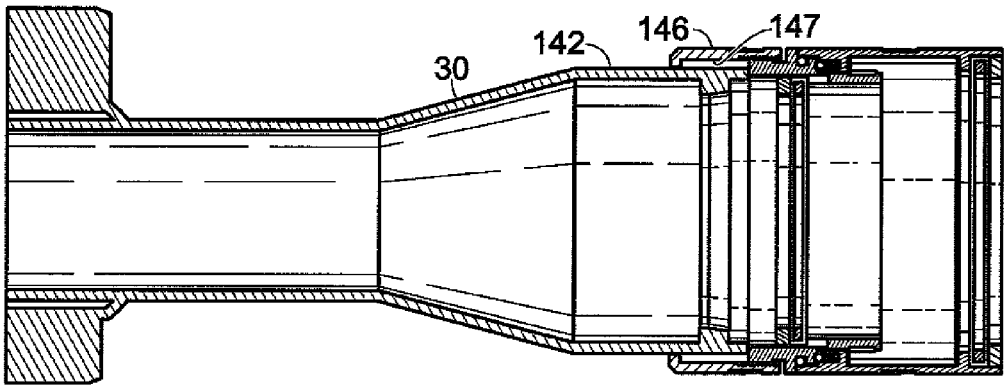
FIG. 31 is a partial section of the lens cover and rifle scope shown in FIG. 30.

Another device and method for mounting the lens cover to the DVO employs compression fitting, as shown in FIGS. 30 and 31. This is similar to the use of an external collet in that an outer band 180 of this mounting device slips over the outside of the objective housing 142 of the DVO. However, instead of providing a collet with fingers on the inside of the housing, a ring of softer material (rubber, plastic, composite, etc.) 147 is provided inside the housing that the threaded ring 146 squeezes as it is tightened. When ring 147 is compressed it grips the interior surface of the housing, thereby securing the lens cover in place.

Lastly, the cover can be made such that a there is an interference fit with the outside of the housing of the DVO. Using this mounting device and method shown in FIG. 32, the cover can be pressed onto the DVO for a secure mount such that friction between interior of the lens cover housing 148 and the exterior of the DVO housing holds the lens cover in place. Using a relatively soft material that can deform easily, such as a plastic or rubber on rear section of the inner rigid tube can allow the cover to be mounted and removed by hand.

Membrane Mounting

The membrane is preferably securely fastened circumferentially around the opposing ends of the outer and inner rigid tube members 48 and 50, respectively shown in the FIGS. 9-11. This can be accomplished in at least the different ways describe hereafter.

Figure 32:
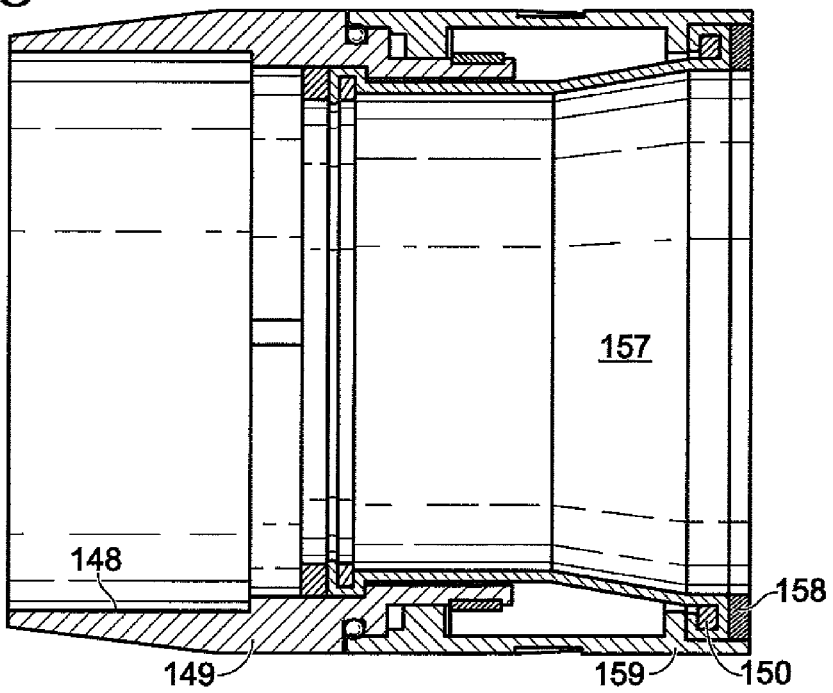
FIG. 32 is a section of a ninth embodiment of the lens cover including a press fit mounting mechanism and a press ring membrane mounting method.

As shown in FIG. 32, the membrane may be secured by a combination of elements including a membrane support ring 150 made of a rigid or semi-rigid material that compresses the membrane 157 into a cavity at the end of the rigid tube and a press ring 158 that has an interference fit with the end of the rigid tube 159. This method and associated elements are a preferred embodiment for reducing cost and complexity.

Figure 33:
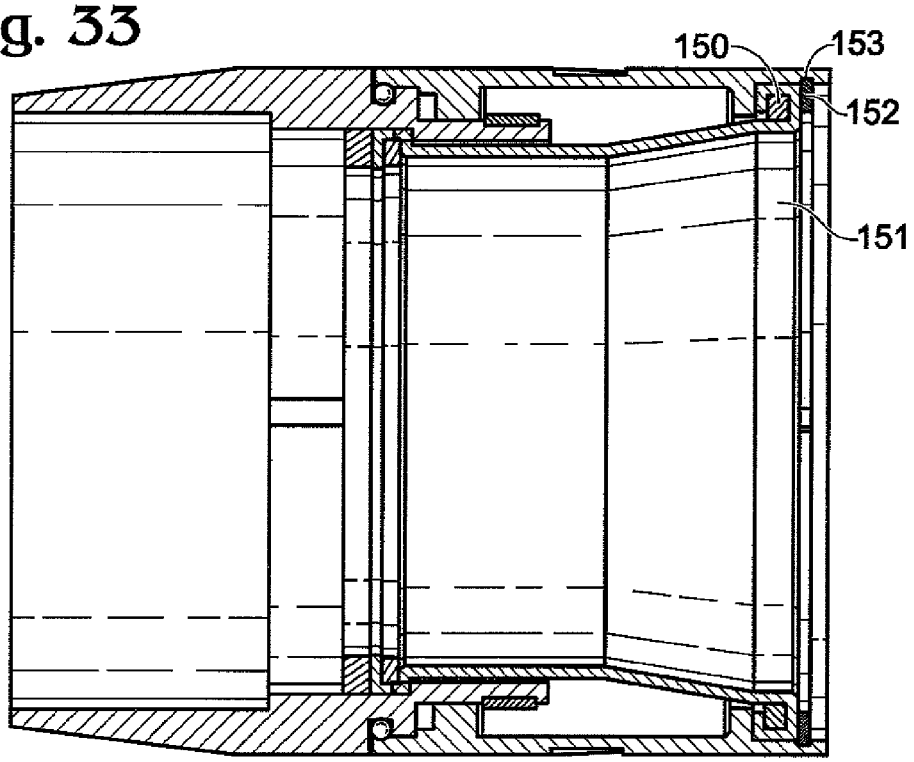
FIG. 33 is a section of a ninth embodiment of the lens cover including a press fit mounting mechanism and a snap ring membrane mounting method.

As shown in FIG. 33, the membrane may be secured by a combination of elements including a membrane support ring 150 made of a rigid or semi-rigid material that compresses the membrane 151 into a cavity at the end of the rigid tube and a retaining ring 152 that snaps into a groove 152 on the rigid tube.

Another way of securing the membrane is to use membrane clamp rings 154, 155 that are attached by bolts 156 to the face perpendicular to the longitudinal (optical) axis 52 of the lens cover, as shown in FIG. 7. One ring and corresponding bolts are attached to both the inner and another to outer membrane mounting points. Preferably, in this embodiment two or more bolts are used to secure the rings, with six at each ring being the preferred number.

Figure 34:
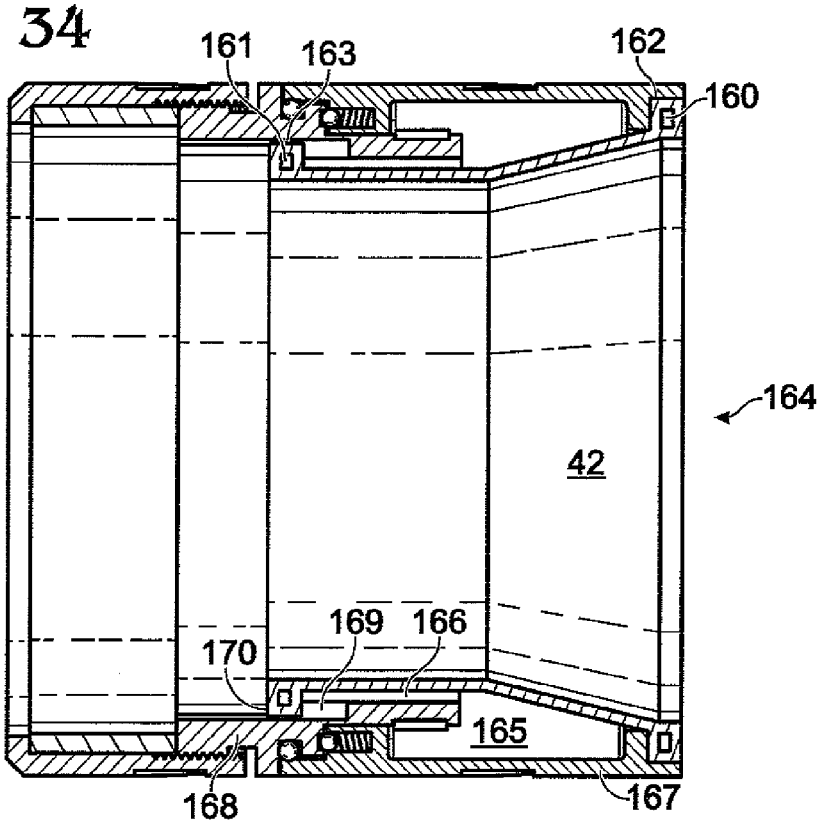
FIG. 34 is a section of a tenth embodiment of the lens cover including a compression fitting mounting mechanism and a comolded and bonded membrane mounting method.

Yet another way of securing the membrane to the opposing ends of the outer and inner tubes, respectively, is to co-molding a rigid support ring 160, 161 into the ends of the membrane and bond those ends of the membrane to the ends of the rigid tubes, as shown in FIG. 34. The adhesive to bond and secure the membrane being applied where the membrane contacts the end of the inner and outer tubes 162, 163.

A further embodiment may be formed by using any combination of the above methods on opposing ends of the outer and inner tubes, respectively.

Membrane Venting

Referring to FIG. 34, when the lens cover 164 is opened and closed there is air trapped between the membrane 42 and sidewalls 165 and 166 of the outer and inner tubes 167 and 168, respectfully. A vent 169 is provided to allow this air in and out so that air cannot be trapped and produce a bubble that would obscure the optical clear aperture. The preferred method and apparatus to accomplish this locates the exit of the vent 170 on the inner rigid tube member 168 so as to enter the area of the rear side of the membrane 42. This ensures that the closure of the lens cover also closes the path of contaminants to the vent and maintains a sealed system. When the membrane is opened, the system will not be sealed and the vent will have access to the outside atmosphere for the passage of air.

Operation

The lens cover is preferably adapted to be mounted to the end of a direct view optic, for example a rifle scope as shown in FIG. 23, in hunting, military combat and law enforcement situations. Having firmly attached lens cover to the optic using one of the methods and apparatuses described above, the user can rotate the outer rigid tube member, as shown in FIG. 10, to close or open the membrane. When the user does not need to see through the rifle scope the cover can be closed. In its closed state the cover protects the objective lens from physical damage and contamination from liquids, dust and dirt. In a situation where the user needs to see through the optic, but wants to minimize his signature from glint off the objective lens or detection from an optical detection technique, the user can open the cover to allow only a small fraction of the objective lens to be visible. This shields the lens almost completely from the sun and minimizes the aperture size which in turn limits the return signature that any optical detection technique would detect.

Figure 38:
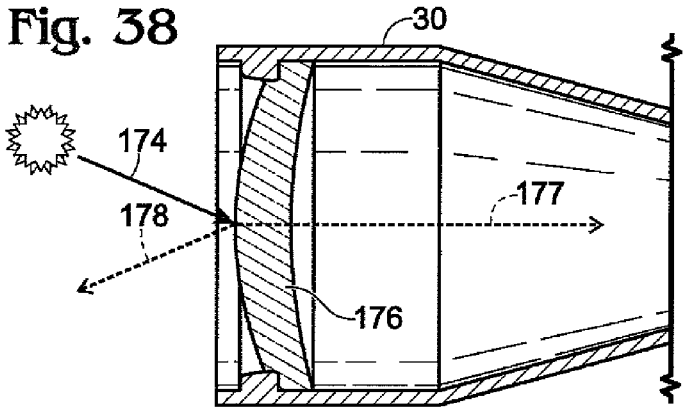
FIG. 38 shows sunlight reflecting off the objective a of rifle scope in the absence of a lens cover according to this disclosure.
Figure 39:
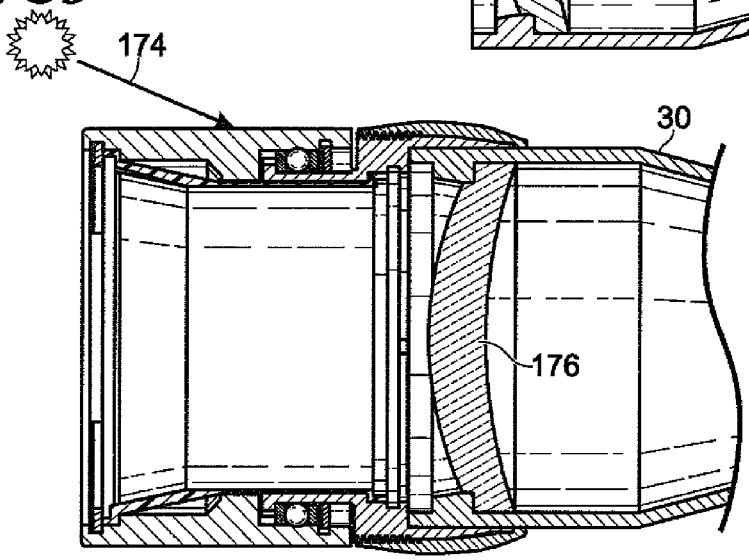
FIG. 39 shows how an embodiment of a lens cover according to this disclosure, namely the embodiment of FIG. 24, shades the objective of a rifle scope.

In a situation where the user is less concerned about his signature or needs more light collected by the objective, the user can be open the lens cover partially or fully, as needed. As shown in FIG. 38, in the absence of a lens cover, light ray 174 from the sun not only reflects off objective lens 176 of rifle scope 30, as shown by light ray 178, so as to produce a rifle scope signature, but enters the rifle scope, as shown by light ray 177, so as to produce glare. However, as shown by FIG. 39, even when the cover is fully open it acts as a sun shade to block light ray 174 so as to limit glare and sunlight reflection off the objective, though to a lesser degree than when the cover is partially closed.

Figure 1:
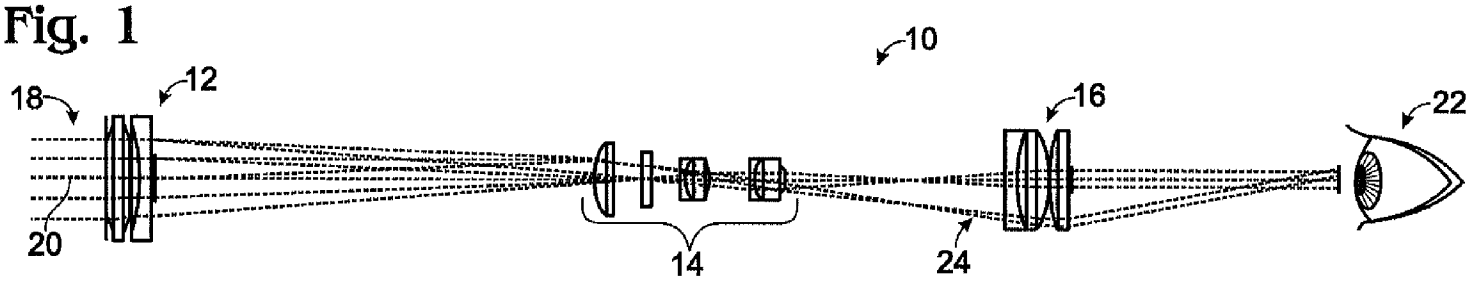
FIG. 1 is a light ray-trace diagram for a typical rifle scope, depicting the rifle scope optical system, a human eye, in-field light rays, and stray light rays.
Figure 2:
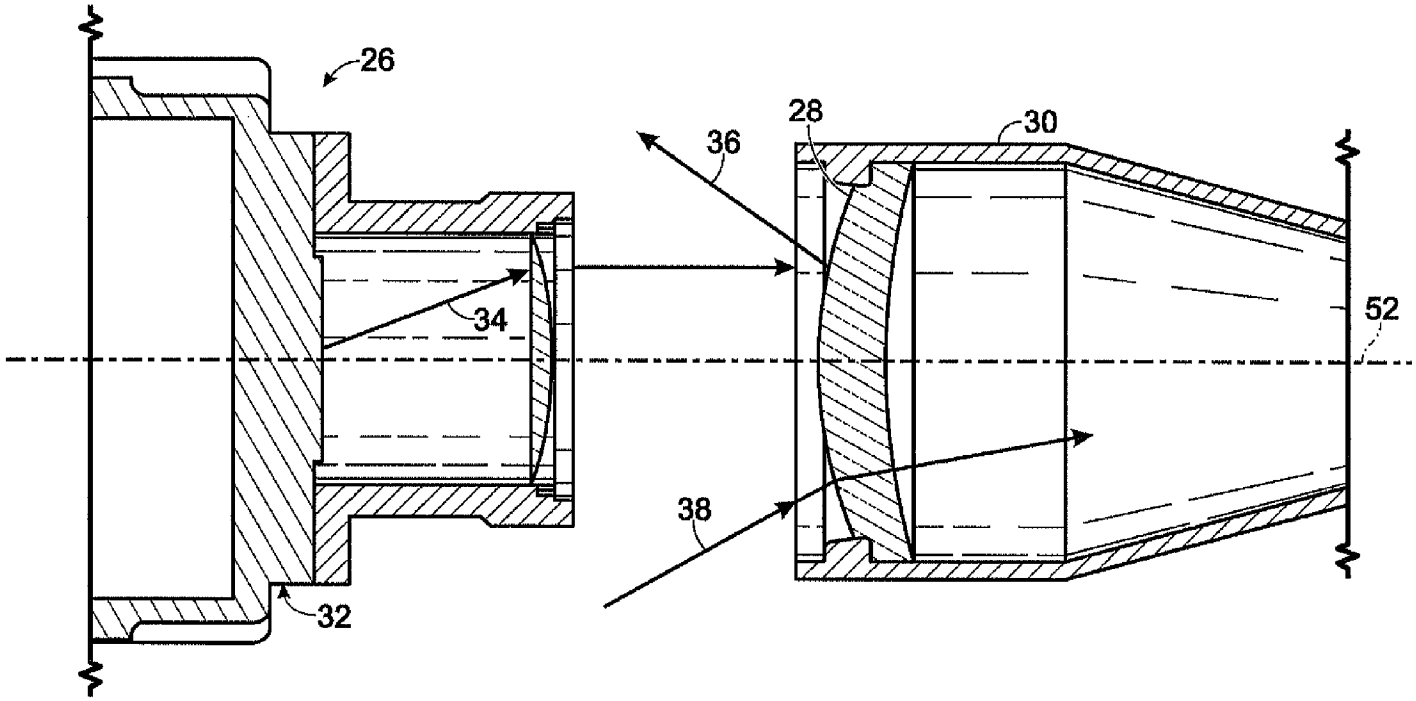
FIG. 2 is a cut away cross section of a typical night vision device in front of a typical rifle scope.
Figure 35:
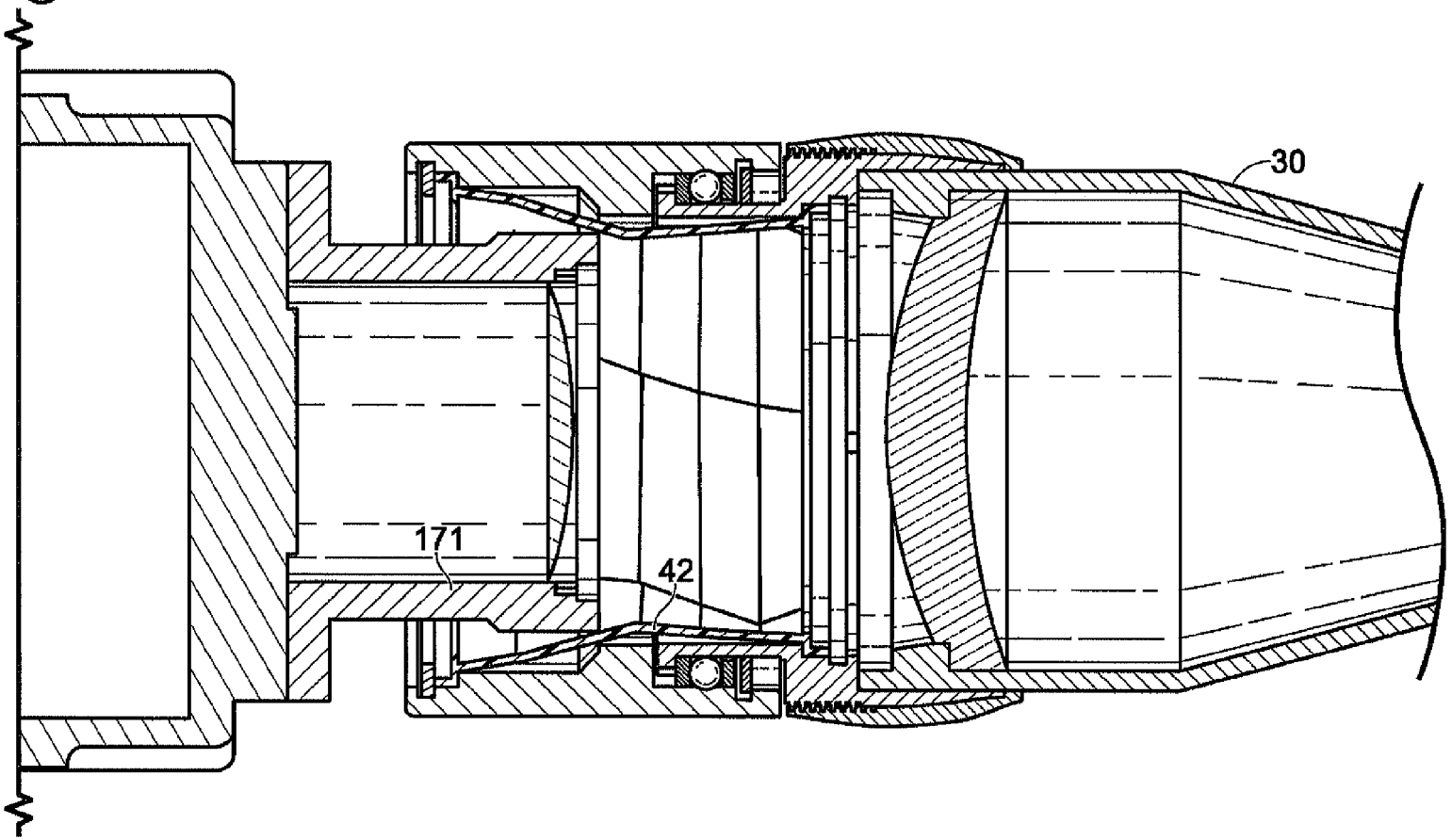
FIG. 35 is a section an eleventh embodiment of the lens cover including a female collet, attached to a rifle scope and as a coupled to a typical night vision device.

It is common in military and law enforcement nighttime situations to use a night vision device that mounts in-line with a direct view optic. For example, as shown in FIG. 8, a night vision device 26 may be mounted in front of a rifle scope 30 with the lens cover 40 of the present disclosure serving as a coupler. Such night vision devices allow the user to look through the direct view optic into the night vision device and see when there is insufficient ambient light to use the DVO alone, or it is desired to observe longer wavelengths of light during the day. Such night vision devices typically have a rear ocular lens piece protruding from the back of the device. When mounted properly as shown in FIG. 2, this lens is aligned with the longitudinal, or optical, axis 52 of the DVO. All night vision devices emit light 34 from the rear ocular so the lens cover of the present invention provides a shroud for the rear ocular lens of a night vision devices, shielding the light from being reflected out and compromising the user from a distance. The cover can be partially closed when the night vision device is installed to completely eliminate such reflected light off the objective lens thereby reducing the user's optical signature in this scenario. It can also completely eliminate any stray ambient light 38 from entering the DVO when being used in the day time. FIG. 35 is a cross section view of a lens cover of present disclosure with the membrane 42 partially closed around the rear ocular lens 171 of the night vision device.

Further mitigation of the optical signature can be accomplished by mounting an optical filter 172, such as a dielectric or absorbing material, interior to the multi-function lens cover as shown in FIG. 13. This filter can be mounted normal, or off-normal, to the optical axis 52, to reduce the reflected return signature at a particular angle.

The terms and expressions which have been employed in the foregoing specification are used therein as terms of description and not of limitation, and there is no intention, in the use of such terms and expressions, to exclude equivalents of the features shown and described or portions thereof, it being recognized that the scope of the invention is defined and limited only by the claims that follow.

The invention claimed is:

1. A lens cover, comprising:

a support structure having a first ring-shaped end, a second ring-shaped end spaced from said first ring-shaped end and a mounting portion for attaching one end of the support structure to a lens;

a ring-shaped rotatable member disposed at the second end of said support structure; and a pliable membrane tube having a first end attached to the first ring-shaped end of the support structure and having a second end attached to the ring-shaped rotatable member, said membrane tube extending between said first ring-shaped end and said ring-shaped rotatable member so that said membrane tube forms an aperture through the support structure and by rotating the rotatable member to twist or untwist the membrane tube the size of said aperture formed by said membrane tube between said first ring-shaped end of the support structure and said ring-shaped rotatable member may be varied, wherein said support structure comprises an enclosure tube, the first ring-shaped end of the support structure comprising a first end of the enclosure tube and the second end of said support structure comprising a second end of the enclosure tube, the membrane tube being disposed within the enclosure tube.

2. The lens cover of claim 1, wherein the enclosure tube comprises at least one substantially light-impenetrable wall.

3. The lens cover of claim 1, wherein the enclosure tube comprises a first substantially-rigid tube member and a second substantially-rigid tube member having a common longitudinal axis, a portion of the first tube member having an outside diameter less than the inside diameter of a portion of the second tube member and being disposed within said portion of the second tube member so that the first tube member can rotate inside the second tube member about the common longitudinal axis and thereby twist the membrane tube.

4. The lens cover of claim 3, wherein the first tube member comprises a first substantially light-impenetrable wall and the second tube member comprises a second substantially light-impenetrable wall.

5. The lens cover of claim 4, further comprising a mechanism wherein the first tube member has a free end not enclosed by the second tube member and the second tube member has a free end opposite the free end of the first tube member along the common longitudinal axis, and one of the free end of the first tube member or the second tube member includes a mounting mechanism for engaging the lens so as to attach the lens cover to the lens.

6. The lens cover of claim 5, wherein the free end of the first or the second tube member opposite the mounting mechanism includes a gripping member for rotating said tube member.

7. The lens cover of claim 5, wherein the mounting mechanism comprises threads disposed at the end of said tube for threading the lens cover into a lens having matching threads.

8. The lens cover of claim 5, wherein the mounting mechanism comprises a female collet system disposed at the end of said tube and adapted to grip the outside of the lens.

9. The lens cover of claim 5, wherein the mounting mechanism comprises an external clamp ring disposed at the end of said tube and secured by at least one pinch bolt.

10. The lens cover of claim 5, wherein the mounting mechanism comprises a male collet system disposed at the end of said tube and adapted to grip the inside surface of the lens housing.

11. The lens cover of claim 5, wherein the mounting mechanism comprises a compression fitting disposed at the end of said tube, adapted to engage the outside of the lens and having a compressible material that becomes compressed when the fitting engages the outside of the lens so as to exert pressure against the outside of the lens.

12. The lens cover of claim 5, wherein the mounting mechanism comprises a sleeve disposed at the end of said tube and adapted to engage the outside of the lens so as to stay in place due to friction.

13. The lens cover of claim 3, wherein the membrane tube comprises an elastic material.

14. The lens cover of claim 3, wherein the membrane tube comprises an elastic portion disposed adjacent the end of said tube member and a composite elastic material and abrasion and puncture resistant portion adjacent the opposite end of the enclosure tube.

15. The lens cover of claim 14, wherein the abrasion and puncture resistant material comprises a material selected from one or more of the group comprising nylon, polyester, aramid, polyimide, PEEK cotton, carbon fiber and ultra-high-molecular-weight polyethylene fiber.

16. The lens cover of claim 3, wherein the membrane tube comprises a material selected from one or more of the group comprising rubber, butyl, neoprene, silicone, nitrile and polyurethane.

17. The lens cover of claim 3, wherein substantially all of the membrane tube comprises a composite of a composite elastic material and a material selected from one or more of the group comprising nylon, polyester, aramid, polyimide, cotton, carbon fiber and ultra-high-molecular-weight polyethylene fiber.

18. The lens cover of claim 3, wherein the membrane tube has a front end and an opposite, back end for connection to a lens, and a membrane thickness that varies between the front end and the back end.

19. The lens cover of claim 3, wherein the membrane tube has a front end, an opposite, back end for connection to a lens, and a central longitudinal axis, and a membrane thickness that varies radially in thickness with respect to the longitudinal axis.

20. The lens cover of claim 19, wherein the membrane thickness also increases toward the front end starting at some location between the front end and the back end.

21. A method for providing a variable external aperture for an imaging system, comprising:

providing a lens cover for said imaging system, the lens cover having a pliable membrane tube, said membrane tube having a front end, a back end and a central longitudinal axis, the front end of the membrane tube being attached to a front cylindrical element and the back end of the tube being attached to a back cylindrical element separated from the front cylindrical element along said longitudinal axis, the front cylindrical portion and the back cylindrical portion being rotatable with respect to one another;

so as to form a variable aperture through said tube for light propagating between the front end of the membrane tube and the front of the imaging system; and attaching the lens cover to the imaging system so as to substantially block light from entering or leaving the imaging system other than through the membrane tube.

22. The method of claim 21, further comprising securing the amount of twist so as to maintain the aperture size.

23. The method of claim 21, wherein membrane tube is provided with elasticity.

* * * * *